United States Patent [19]

Swanson

[11] Patent Number: 4,513,510

[45] Date of Patent: Apr. 30, 1985

[54] MEASURING TOOL

[76] Inventor: Ronald C. Swanson, P.O. Box 434, Oak Lawn, Ill. 60453

[21] Appl. No.: 611,614

[22] Filed: May 18, 1984

[51] Int. Cl.[3] ..... B43L 7/00; B43L 13/24

[52] U.S. Cl. ..... 33/419; 33/173; 33/427

[58] Field of Search ..... 33/419, 427, 423, 425, 33/479, 480, 173

[56] References Cited

U.S. PATENT DOCUMENTS

| | | | |
|---|---|---|---|
| 175,113 | 3/1876 | Kuhns | 33/173 |
| 183,387 | 10/1876 | Essex | 33/173 |
| 864,096 | 8/1907 | Kaempf | 33/427 |
| 1,001,316 | 8/1911 | Smith | 33/173 |
| 1,014,453 | 1/1912 | Clark et al. | 33/173 |
| 2,805,484 | 9/1957 | D'Aoust | 33/173 |
| 3,623,232 | 11/1971 | Hahlstadt | 33/173 |
| 4,244,105 | 1/1981 | Goussios | 33/419 |

*Primary Examiner*—Robert I. Smith
*Attorney, Agent, or Firm*—John Vander Weit, Jr.

[57] ABSTRACT

A measuring tool including a flat member having the shape of a right triangle and having upper and lower surfaces and a first side and second side which form a right angle at their intersection, a tee affixed along the edge of the first side which is perpendicular to the flat member and extends from both the upper and lower surfaces of the flat member, a first slot extending along the first side and running approximately parallel to the first side, a first stop bolt slidably affixable in the first slot, a second slot extending along the second side and running approximately parallel to the second side; a layout bar having a thickness equal to that of the extension of the tee from the surface of the flat member, the layout bar having a fastening slot perpendicular to the second slot and being alignable with the second slot; the layout bar having a recessed channel running along its length, and a second stop bolt slidably affixable in the recessed channel so that the tee and the layout bar when affixed to the flat member provide a planar surface along the first and second sides, the planar surface being substantially parallel to the surface of the flat member, and the first and second stop bolts extend away from the surface of the flat member and beyond the planar surface formed by the tee and the layout bar.

8 Claims, 8 Drawing Figures

FIG. 1
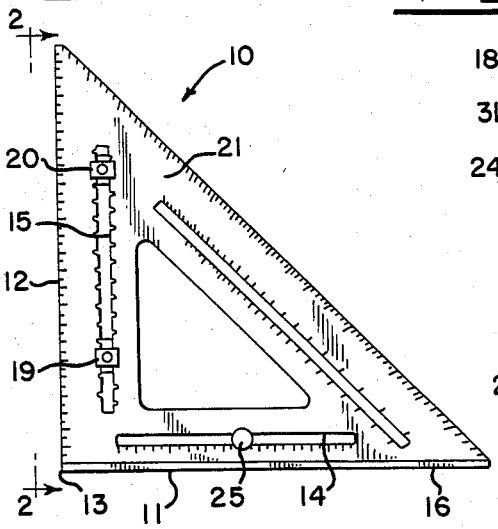
FIG. 2
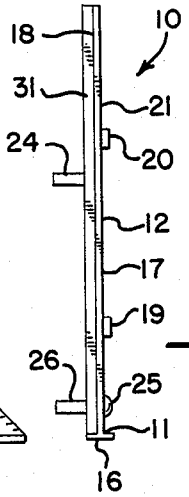
FIG. 8
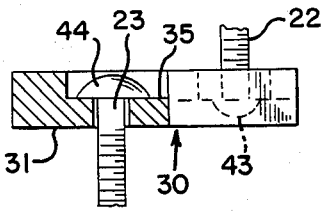
FIG. 5
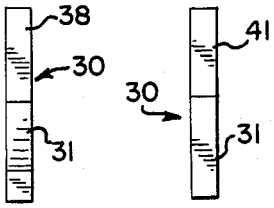
FIG. 6
FIG. 3
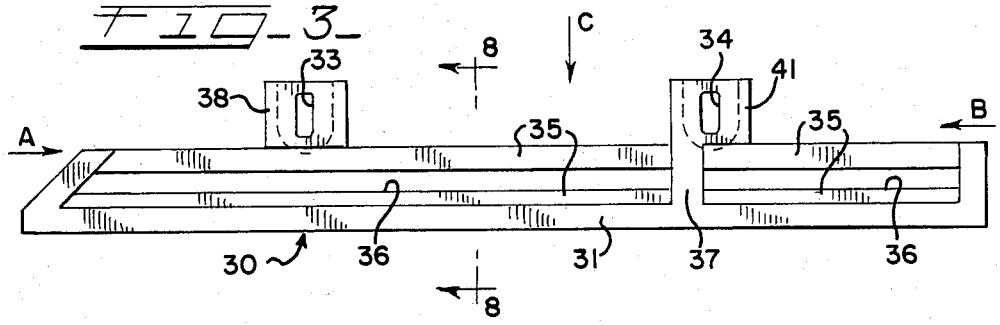
FIG. 4
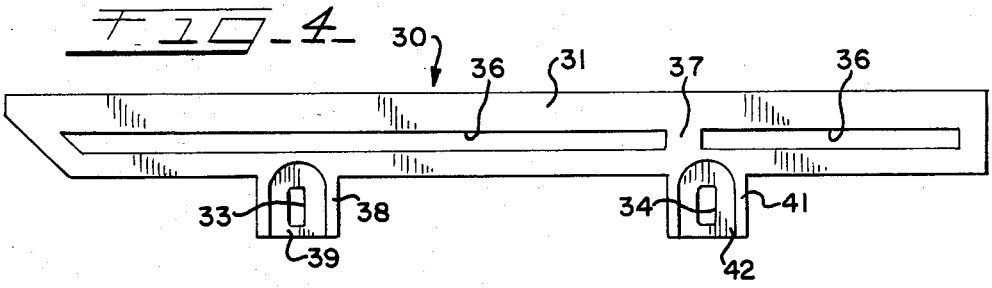
FIG. 7
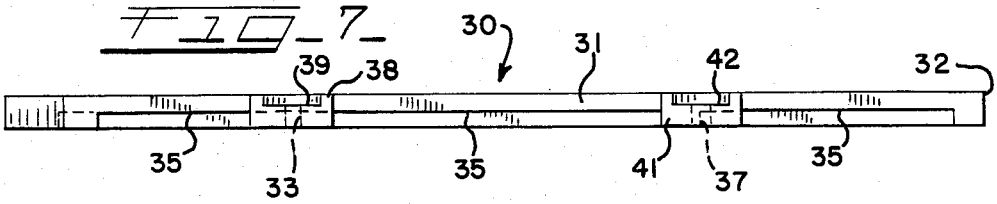

MEASURING TOOL

BACKGROUND OF THE INVENTION

This invention relates generally to measuring tools and more particularily concerns a square which is adaptable with a layout bar to provide for convenient repeated marking of predetermined angles.

In laying out stringers, a person has to mark a depth of run of a step and the rise height of each step along a rectangular stringer board. In the past this has been done with the use of a square whereby the depth and rise had to be adjusted each time before the user can mark the stringer. This caused problems since it took individual measurements of depth and rise for each step. If any measurement was inaccurate, the steps would be uneven.

Accordingly, it is an object to this invention to provide a measuring tool wherein once the depth and rise of a step are determined a user can adjust the measuring tool to provide for consistent markings of the step along the stringer and thus eliminate the human error in measuring the depth or rise for each individual step.

Another object of the invention is to provide a square which allows for minor errors or deviations from a 90° angle and an accurate reproduction of such deviated angle.

SUMMARY OF THE INVENTION

In accordance with the invention, a measuring tool is provided including a flat member having the shape of a right triangle and having upper and lower surfaces and a first side and second side which form a right angle at their intersection, a tee affixed along the edge of the first side which is perpendicular to the flat member and extends from both the upper and lower surfaces of the flat member, a first slot extending along the first side and running approximately parallel to the first side, a first stop bolt slidably affixable in the first slot, a second slot extending along the second side and running approximately parallel to the second side, a layout bar having a thickness equal to that of the extension of the tee from the surface of the flat member, the layout bar having a fastening slot perpendicular to the second slot and being alignable with the second slot, the layout bar having a recessed channel running along its length, and a second stop bolt slidably affixable in the recessed channel so that the tee and the layout bar when affixed to the flat member provide a planar surface along the first and second sides, the planar surface being substantially parallel to the surface of the flat member, and the first and second stop bolts extend away from the surface of the flat member and beyond the planar surface formed by the tee and the layout bar.

BRIEF DESCRIPTION OF THE DRAWINGS

Other objects and advantages in the invention will become apparent upon reading the following detailed description and upon reference to the drawings, in which:

FIG. 1 is a top view of the measuring tool of the instant invention;

FIG. 2 is a side view of the measuring tool of FIG. 1;

FIG. 3 is a top view of a layout bar constructed in accordance with the principals of the instant invention;

FIG. 4 is a bottom view of the layout bar of FIG. 3;

FIG. 5 is an end view of the layout bar of FIG. 3 shown along the sight line A;

FIG. 6 is an end view of the layout bar bar of FIG. 3 along sight line B;

FIG. 7 is a side view of the layout bar of FIG. 3 along sight line C; and, FIG. 8 is a sectional view of layout bar of FIG. 3 taken along sight line 8—8 showing a partial view of stop bolt and fastener.

While the invention will be described in connection with a preferred embodiment, it should be understood that it is not intended to limit the instant invention to that embodiment. On the contrary it is intended to cover all alternatives, modifications and equivalents as may be included within the spirit and scope of the invention as defined by the appended claims.

DETAILED DESCRIPTION OF THE INVENTION

Turning first to FIG. 1, there is shown a measuring tool 10 constructed in accordance with the instant invention. Measuring tool 10 includes a flat member 21 having a first side 11 and a second side 12 which intersect and form a right angle at point 13. First side 11 has a first slot 14 running generally parallel to first side 11. Second side 12 has a second slot 15 running generally parallel to second side 12. First side 11 has a tee 16 affixed along its edge which runs perpendicular to the upper surface 17 and the lower surface 18 of flat member 21. Tee 16 extends away from upper surface 17 and lower surface 18 of flat member 21. FIGS. 1 and 2 show a first fastening nut 19 and a second fastening nut 20. Fastening nuts 19 and 20 are used along with fastening bolts such as fastening bolt 22 to attach a layout bar 30 to flat member 21. A first stop bolt 25 is attached by a first stop 26 in first slot 14. Likewise a second stop bolt 23 is attached to a second stop 24 in layout bar 30.

FIGS. 3 through 8 show a layout bar 30 constructed in accordance with the instant invention. Layout bar 30 includes member 31 having a shape so that its sides align with sides of flat member 21. The thickness of layout bar side 32 is such that it is equal to the extension of tee 16 from lower surface 18 of flat member 21. Layout bar 30 is affixed to flat member 21 by fastening slots 33 and 34 which are alignable with second slot 15. Layout bar 30 has a recessed channel 35 running along its length. Recessed channel 35 has a recessed channel slot 36 through which second stop bolt 23 can pass and be slidably affixed to recessed channel slot 36 by second stop 24. Second stop bolt 23 thus, may be slidably affixable to layout bar 30 along substantially all of the length of recessed channel 35 except for a portion 37. Portion 37 can be removed to make recessed channel 35 and recessed channel slot 36 continuous, however, it is preferred to have portion 37 so as to strengthen layout bar 30. Portion 37 does not interfere substantially with the use of measuring tool 10. Fastening slot 33 is attached to layout bar 30 by a fastening tab 38 which has a recessed portion 39. Similarily, fastening slot 34 is attached to layout bar 31 by a fastening tab 41 which has a recessed portion 42.

As best seen in FIG. 8, layout bar 30 is fastened to flat member 21 by fastener 22 which is connected with fastening nut 20. The head 43 of fastener 22 lies in recessed portion 39 of fastening tab 38. Likewise the head 44 of second stop bolt 23 lies in recessed channel 35 and is slidably affixed therein by second stop 24.

As best shown in FIG. 2, when layout bar 30 is affixed to flat member 21, the lower portion of layout bar 30 and tee 16 form a planar surface. First stop bolt 25 and first stop 26 and second stop bolt 23 and second stop 24 are the only protrusions of measuring tool 10 which extend beyond the planar surface defined by layout bar 30 and tee 16.

During use of the measuring tool of the instant invention in positioning steps on a stringer, point 13 is aligned to a position where a step is desired with layout bar 30 and tee 16 against the stringer. Then first stop bolt 25 and first stop 26 are adjusted in first slot 14 so that first stop 26 rests firmly against the side of the stringer. Similarily, second stop bolt 23 and second stop 24 are adjusted in recessed channel slot 36 so that second stop 24 rests firmly against the side of the stringer. The user can then mark the step with a marking device along the tee 16 of first side 11 and second side 12 of measuring tool 10. The user can then merely slide the tool along the stringer and mark additional steps which will be identical to the step just marked. Thus, any errors in realigning measuring tool 10 for each step along the stringer are eliminated.

Another particular use of the instant invention is wherein a user wants to reproduce accurately a corner or other measurement that is supposed to be 90° but due to error in construction is slightly off of 90°. For this use, the fasteners and fastener nuts of layout bar 30 are loosened and layout bar 30 is positioned to accurately follow the deviated corner and then fasteners of the layout bar 30 are tightened. Now the user has an exact copy of the deviated angle which can be marked on any particular surface which he desires to match with such deviated corner. Thus, it is aparent that there has been provided in accordance with the invention a measuring tool that fully satisfies the objects, aims, and advantages set forth above. While the invention has been described in conjunction with specific embodiments thereof, it is evident that many alternatives, modifications, and variations will be apparent to those skilled in the art in light of the forgoing description. Accordingly, it is intended to embrace all such alternatives, modifications, and variations as fall within the spirit and broad scope of the appended claims.

I claim:

1. A measuring tool including:

a flat member having the shape of a right triangle and having upper and lower surfaces and a first side and second side which form a right angle at their intersection;

a tee affixed along the edge of said first side which is perpendicular to said flat member and extends from both said upper and lower surfaces of said flat member;

a first slot extending along said first side and running approximately parallel to said first side;

a first stop bolt slidably affixable in said first slot;

a second slot extending along said second side and running approximately parallel to said second side;

a layout bar having a thickness equal to that of the extension of said tee from said surface of said flat member;

said layout bar having a fastening slot perpendicular to said second slot and being alignable with said second slot;

said layout bar having a recessed channel running along its length; and, a second stop bolt slidably affixable in said recessed channel so that said tee and said layout bar when affixed to said flat member provide a planar surface along said first and second sides, said planar surface being substantially parallel to said surface of said flat member, and said first and second stop bolts extend away from said surface of said flat member and beyond said planar surface formed by said tee and said layout bar.

2. A measuring tool as in claim 1 wherein said recessed channel has a recessed channel slot which runs along its length.

3. A measuring tool as in claim 2 wherein said second stop bolt includes a headed portion which is affixable in said recessed channel slot so as to not extend outside of said recessed channel.

4. A measuring tool as in claim 3 wherein said second stop bolt includes said headed portion having a threaded male portion which may be affixed to said layout bar by a second stop having a complimentary threaded female portion.

5. A measuring tool as in claim 1 wherein said first stop bolt includes a headed portion having a threaded male portion which may be affixed to said layout bar by a first stop having a complimentary threaded female portion.

6. A measuring tool as in claim 1 wherein said layout bar is affixed to said flat member by fasteners which have headed portions with threaded male portions and fastening nuts which have complimentary threaded female members.

7. A measuring tool as in claim 6 wherein said layout bar has fastening tabs with recessed portions so that when said fasteners are affixed, said headed portions of said fasteners do not extend outside of said recessed portions of said fastening tabs.

8. A measuring tool as in claim 7 wherein said layout bar has a re-enforcing portion in said recessed channel associated with one of said fastening tabs.

* * * * *